United States Patent [19]

Garlapaty

[11] Patent Number: 4,481,869

[45] Date of Patent: Nov. 13, 1984

[54] FLUID OPERATED DEVICE WITH IMPROVED SEALING MEANS

[75] Inventor: Venkat R. Garlapaty, Utica, Mich.

[73] Assignee: Greenco Corp., Dearborn, Mich.

[21] Appl. No.: 378,094

[22] Filed: May 14, 1982

[51] Int. Cl.[3] ..... F01B 29/08

[52] U.S. Cl. ..... 92/88; 92/165 R; 277/80; 277/DIG. 7; 248/206.5

[58] Field of Search ..... 91/DIG. 4; 92/88, 165; 277/80, DIG. 7; 248/206.5, 206 A; 244/63; 211/DIG. 1; 24/303

[56] References Cited

U.S. PATENT DOCUMENTS

| | | | |
|---|---|---|---|
| 3,058,504 | 10/1962 | Powers | 211/DIG. 1 |
| 3,820,446 | 6/1974 | Granbom et al. | 92/88 |
| 3,893,378 | 7/1975 | Hewitt | 92/88 |
| 4,164,893 | 8/1979 | Granbom et al. | 92/88 |
| 4,373,427 | 2/1983 | Garlapaty et al. | 92/88 |

*Primary Examiner*—Robert E. Garrett

*Assistant Examiner*—Richard S. Meyer

*Attorney, Agent, or Firm*—Gifford, VanOphem, Sheridan, Sprinkle & Nabozny

[57] ABSTRACT

A fluid operated device comprising an elongated housing defining an elongated interior cylinder and an elongated slot formed along one side of the housing and open to the cylinder. A piston is longitudinally, slidably mounted in the cylinder and forms a first chamber in the cylinder between one end of the housing and one end of the piston and a second chamber between the other end of the housing and the other end of the piston. Fluid seals are provided around each end of the piston. In addition, an elongated band constructed of a magnetic material is secured within the cylinder and is of sufficient width so that the band covers the housing slot. A pair of elongated flexible magnets are secured to the housing along the slot to magnetically attract the band against the housing and thus sealingly close the housing slot along the cylinder chambers.

3 Claims, 4 Drawing Figures

FLUID OPERATED DEVICE WITH IMPROVED SEALING MEANS

BACKGROUND OF THE INVENTION

1. Field of the Invention

The present invention relates generally to fluid operated devices and, more particularly, to a fluid operated device with improved sealing means.

2. Description of the Prior Art

There have been previously known fluid operated devices comprising an elongated housing defining an elongated cylinder and in which a piston is longitudinally slidably mounted. Furthermore, the piston defines a chamber between one end of the piston and one end of the housing and a second chamber between the other other end of the piston and the other end of the housing. Consequently, pressurization of one chamber moves the piston in one direction along the cylinder while, conversely, pressurization of the other chamber moves the piston in the opposite direction.

In some applications, for example, when the fluid operated device is utilized to operate the window of a motor vehicle, an elongated slot is formed along one side of the housing which is open to the cylinder. The piston then includes an arm which protrudes outwardly through the slot and is attached to the window of the motor vehicle. Consequently, movement of the piston simultaneously moves the window with it.

Since the housing slot is necessary to connect the piston to the vehicle window, however, it is necessary to sealingly close the slot along the chambers regardless of the position of the piston. Otherwise, pressurization of either, chamber would simply result in the fluid escaping through the housing slot.

It has been the previous practice to secure an elongated band which is routed under the piston arm but which otherwise flatly abuts against and covers the housing slot along the chambers. Thus, the band still permits the piston to longitudinally slide along the cylinder but provides a fluid seal of the slot along the cylinder chambers. Since such fluid operated devices are typically pneumatically operated, some air leakage through the housing slot is insignificant.

One disadvantage of these previously known devices, however, is that the band in relatively large stroke cylinders tends to fall away from the slot because of self weight and leak, and even a relatively small deformation of the band seal can cause a large air leakage from the chambers and render the entire fluid operated device inoperable.

SUMMARY OF THE PRESENT INVENTION

The present invention provides a fluid operated device which overcomes the above mentioned disadvantages of the previously known devices.

In brief, the fluid operated device according to the present invention comprises an elongated housing defining an elongated interior cylinder. An elongated slot is forced along one side of the housing and the slot is open to the cylinder.

A piston is longitudinally slidably mounted within the cylinder and forms a first chamber between one end of the cylinder and one end of the piston and a second chamber between the other end of the cylinder and the other end of the piston. Fluid seals are provided at each end of the piston to fluidly close the ends of the cylinder.

An elongated band constructed of a flexible magnetic material is secured to opposite ends of the housing and positioned within the cylinder so that one side of the band faces the slotted side of the housing. Furthermore, the band has a width greater than the slot so that, with the band in abutment with the slotted side of the housing, the band covers the slot and fluidly seals the cylinder chambers.

In order to enhance the fluid sealing of the band against the housing and across the slot, an elongated flexible magnet is secured to the housing along each side of the slot. These magnets attract the band against them and, in doing so, closes the housing slot and fluidly seals the cylinder chambers. Thereafter, pressurization of one chamber moves the piston in one direction and vice versa.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
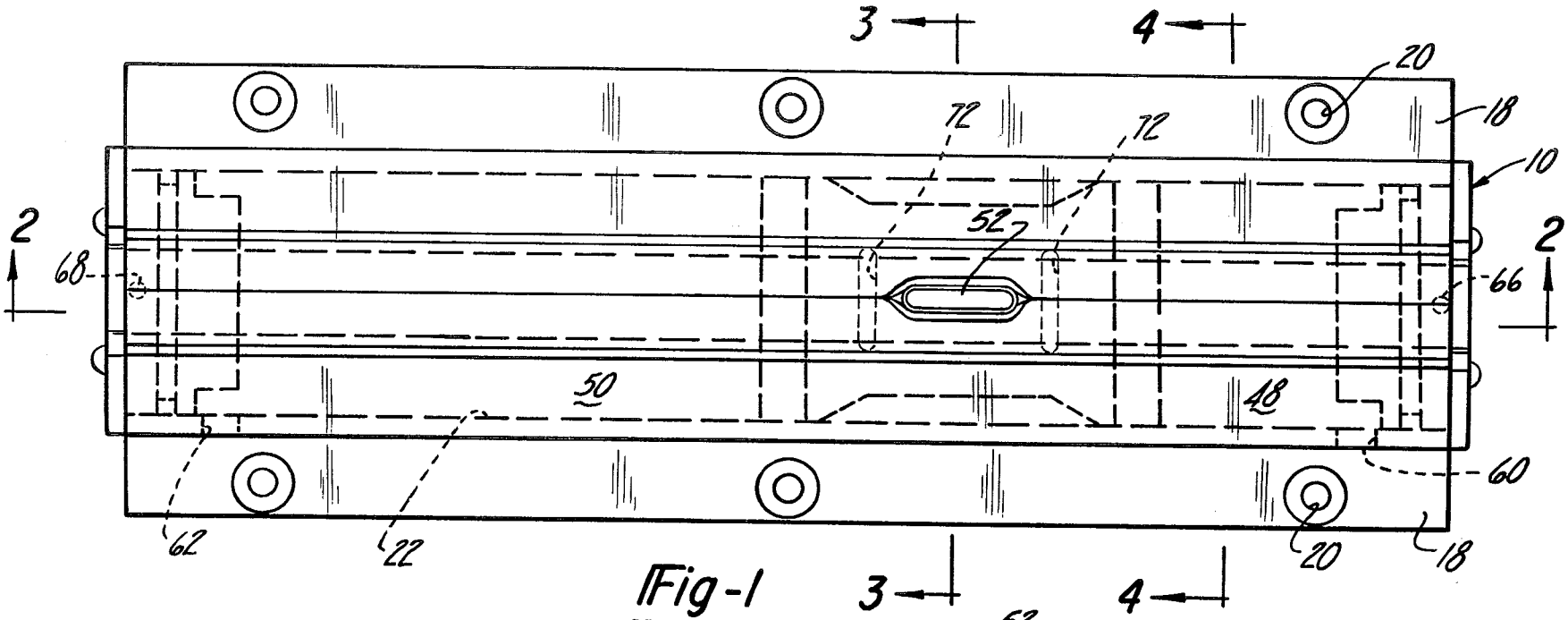
FIG. 1 is a top view illustrating a preferred form of the fluid operated device according to the present invention.
Figure 2:
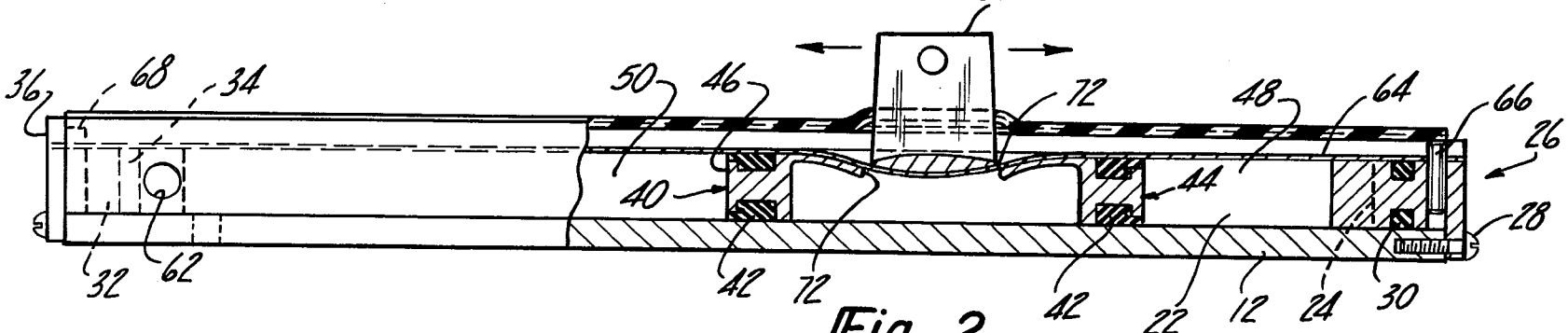
FIG. 2 is a longitudinal sectional view taken substantially along line 2—2 in FIG. 1.
Figure 3:
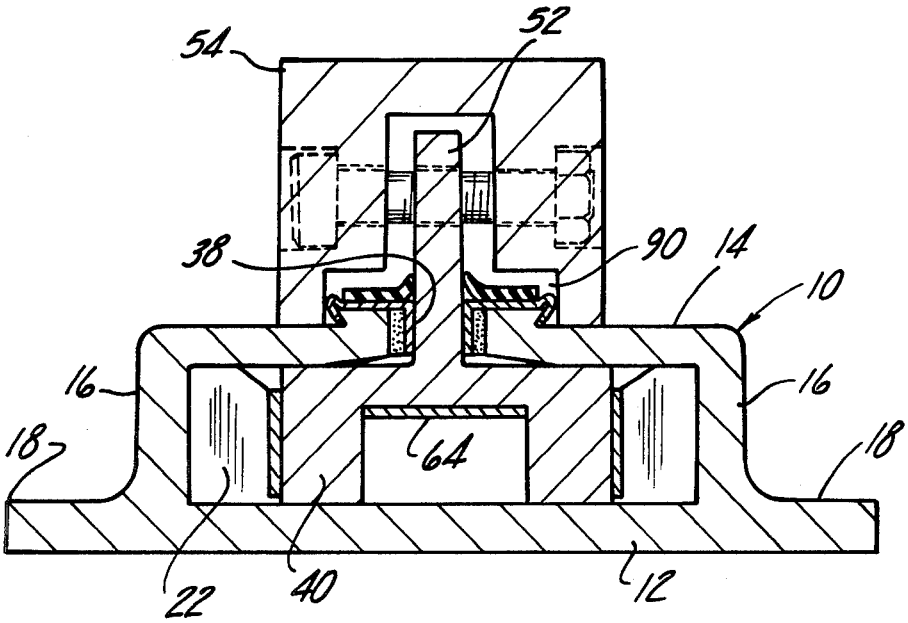
FIG. 3 is a cross sectional view taken substantially along line 3—3 in FIG. 1.

With reference first to FIGS. 1–3, a preferred embodiment of the fluid operated device according to the present invention is thereshown and comprises an elongated housing 10 having a bottom wall 12, top wall 14 and side walls 16. The housing walls 12, 14 and 16 are preferably integrally constructed and the bottom wall 12 includes an outwardly extending flange 18 from each side. This flange 18 includes mounting holes 20 (FIG. 1) for securing the housing 10 to a supporting structure (not shown).

As is best shown in FIGS. 2 and 3, the housing 10 forms an elongated interior cylinder 22 which is generally rectangular in cross sectional shape. An end plug 24 (FIG. 2) is secured to one end 26 of the housing 10 by conventional fasteners 28 and includes a fluid seal 30 to fluidly close one end of the cylinder 22. Similarly, a second end plug 32 (FIG. 2) with a fluid seal 34 is secured to the other end 36 of the housing 10 to fluidly seal the opposite end of the cylinder 22.

Figure 4:
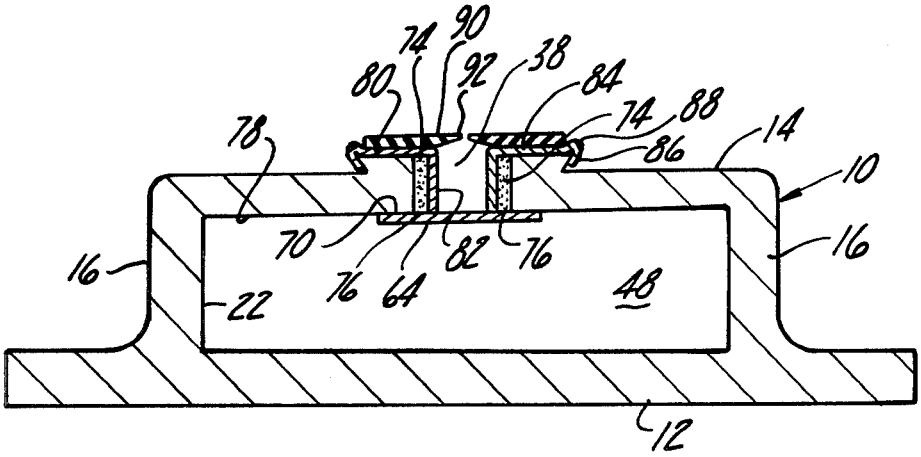
FIG. 4 is a cross sectional view taken substantially along line 4—4 in FIG. 1.

As is best shown in FIG. 4, an elongated and longitudinally extending slot 38 is formed through the top wall 14 of the housing and is open to the cylinder 22. The purpose of this slot 38 will soon become apparent.

With reference now particularly to FIGS. 2 and 3, a piston 40 is longitudinally slidably disposed within the cylinder 22. Fluid seals 42 (FIG. 2) are provided around each end 44 and 46 of the piston 40 to fluidly seal the piston 40 to the housing cylinder 22. Consequently, the piston 40 divides the cylinder 22 into a first chamber 48 between one end 44 of the piston 40 and the housing end 26 and a second chamber 50 between the other end 46 of the piston and the housing end 36. The volume of these cylinder chambers 48 and 50 will vary depending upon the longitudinal position of the piston 40.

With reference still to FIGS. 2 and 3, the piston 40 includes an arm 52 integrally formed with it and which extends out through the housing slot 38. This arm 52 is secured by any conventional means, such as a vehicle window mounting 54, so that the mounting 54 moves in unison with the cylinder 40.

As is best shown in FIG. 1, a first fluid port 60 in the housing 10 is open to the chamber 48 while a second fluid port 62 is open to the other chamber 50. The device of the present invention is preferably pneumatically operated so that pressurization of the cylinder chamber 50 through the port 62 forces the piston 40 rightward, as viewed in FIG. 1 while pressurization of the other cylinder chamber 48 through the port 60 forces the piston 40 leftward as viewed in FIG. 1.

With reference now particularly to FIGS. 2 and 4, in order to prevent air leakage through the housing slot 38, an elongated band 64 is secured at one end by a roll pin 66 to the housing end 26. Similarly, the opposite end of the band 64 is secured to the housing 10 adjacent its other end 36 by a second roll pin 68. The band 64 has a width greater than the width of the housing slot 38, as best shown in FIG. 4, and is positioned within the cylinder 22 so that one side 70 of the band 64 flatly abuts against the cylinder 22 along the top wall 78 and covers the slot 38.

Referring now to FIGS. 1 and 2, the band 64 extends through a pair of slots 72 formed on opposite sides of the piston arm 52 so that the band 64 extends underneath the piston arm 52. The slots 72, however, are formed in between the piston seals 42 so that the band 64 maintains an effective fluid seal of the housing slot 38 along both cylinder chambers 48 and 50 regardless of the position of the piston 40.

With reference now particularly to FIG. 4, in order to enhance the fluid seal between the band 64 and the housing 10, the band 64 is constructed of a magnetic material, i.e., a material which is capable of being magnetized. In the preferred form of the invention, the band 64 is constructed of spring steel.

A pair of elongated flexible magnets 74 are secured on opposite sides of the housing slot 38 so that one edge 76 of each flexible magnet 74 is substantially flush with the top wall 78 of the cylinder 22. Thus, as shown in FIG. 4, the flexible magnets 74 attract the band 64 against it to fluidly seal the housing slot 38.

Still referring to FIG. 4, although other means can be used to secure the magnets 74 to the housing 10, in the preferred form of the invention an elongated magnet retainer 80 is secured to each flexible magnet 74. The retainer 80 includes one leg 82 which is attached to the flexible magnet 74 and sandwiches the flexible magnet 74 between the retainer leg 82 and one side of the housing slot 38. A second leg 84 of the magnet retainer 80 extends perpendicularly outwardly from the outer edge of the first leg 82 and thus extends outwardly from the housing slot 38 and flatly against the top of the housing 10.

The housing 10 also preferably includes a pair of inwardly tapered abutment surfaces 86 which are parallel to and spaced outwardly from each side of the housing slot 38. A lip 88 is formed along the outer edge of the second leg 84 of each magnet retainer 80 which engages the abutment surface 86 to secure the magnet retainers 80 and their attached flexible magnets 74 to the housing 10.

With reference now to FIGS. 3 and 4, a resilient wiper 90 is preferably secured to the free side of the magnet retainer second legs 84 so that the facing edges 92 of the wipers 90 are closely adjacent each other (FIG. 4). The wipers 90 prevent the accummulation of debris within the housing slot 38 but are capable of spreading apart, as shown in FIG. 3, to allow the passage of the piston arm 52 through the housing slot 38.

From the foregoing, it can be seen that the flexible magnets 74 for positively attracting the band 64 against the housing 10 and across the slot 38 provides a more positive sealing of the housing slot 38 than the previously known devices. Furthermore, even in the event that the band 64 becomes twisted or otherwise distorted, the flexible magnets 74 positively attract the band 64 against the housing 10 thus minimizing fluid or air leakage through the housing slot 38 despite such distortion.

A still further advantage of the present invention is that, in the event that the flexible magnets 74 or their retainers 80 become damaged, the magnet retainer 80 and magnets can be easily, rapidly and inexpensively replaced.

Having described my invention, however, many modifications thereto will become apparent to those skilled in the art to which it pertains without deviation from the spirit of the invention as defined by the scope of the appended claims.

I claim:

1. A fluid operated device comprising:

An elongated housing, defining an elongated interior cylinder, said housing having an elongated slot formed along one side and open to said cylinder, and an elongated abutment surface substantially parallel but spaced outwardly from each side of said slot, a piston longitudinally slidable mounted in said cylinder, said piston forming a first chamber in said cylinder between one end of said housing and one end of said piston and a second chamber in said cylinder between the other end of the housing and the other end of said piston, means for fluidly sealing said ends of said piston to said cylinder, means for fluidly sealing said slot along said chambers comprising:

an elongated band constructed of a magnetic material and having a width greater than the width of said slot, means for securing said band within said cylinder and adjacent said slotted side of said housing so that one side of said band faces and covers said slot, means for magnetically attracting said band to said one side of said housing and across said slot, said magnetic attracting means comprising a pair of elongated magnets, each magnet having two opposed sides and two opposed edges and, means for securing said elongated magnets to said housing along opposite sides of said slot so that one edge of each elongated magnet is substantially flush with the inner surface of said cylinder wherein said securing means comprises a pair of elongated magnet retainers, each magnet retainer having an elongated first leg and a substantially perpendicular elongated second leg, means for attaching the first leg of each retainer to one of said magnets so that each magnet is sandwiched in between said first leg of its associated retainer and its associated side of said slot, and means for attaching the second leg of each retainer to said housing comprising a lip formed at the free edge of said second retainer leg which lockingly engages said housing abutment surface, and an elongated resilient wiper secured to the second leg of each magnet retainer said wipers each having an edge which extends over a portion of said slot so that said edges of said wipers are closely adjacent each other.

2. The invention as defined in claim 1 wherein said elongated magnets are flexible magnets.

3. The invention as defined in claim 1 wherein said piston is generally rectangular in cross sectional shape and has an integrally formed extension.

* * * * *